United States Patent [19]

Clough

[11] Patent Number: 4,948,932

[45] Date of Patent: Aug. 14, 1990

[54] APERTURED MICROWAVE REACTIVE PACKAGE

[75] Inventor: Jane L. Clough, Neenah, Wis.

[73] Assignee: James River Corporation, Richmond, Va.

[21] Appl. No.: 348,209

[22] Filed: May 5, 1989

Related U.S. Application Data

[63] Continuation of Ser. No. 186,334, Apr. 26, 1988, abandoned.

[51] Int. Cl.[5] ..... H05B 6/80

[52] U.S. Cl. ..... 219/10.55 E; 219/10.55 F; 426/107; 426/234; 426/243; 99/DIG. 14

[58] Field of Search ..... 219/10.55 E, 10.55 F; 99/DIG. 14; 426/107, 243, 241, 234

[56] References Cited

U.S. PATENT DOCUMENTS

| | | | |
|---|---|---|---|
| 4,190,757 | 2/1980 | Turpin et al. | 219/10.55 E |
| 4,204,105 | 5/1980 | Leveckis et al. | 219/10.55 E |
| 4,230,924 | 10/1980 | Brastad et al. | 219/10.55 E |
| 4,267,820 | 5/1981 | Brastad | 219/10.55 E |
| 4,626,641 | 12/1986 | Brown | 219/10.55 E |
| 4,641,005 | 2/1987 | Seiferth | 219/10.55 E |
| 4,656,325 | 4/1987 | Keefer | 219/10.55 E |
| 4,676,857 | 6/1987 | Scharr et al. | 219/10.55 E |
| 4,689,458 | 8/1987 | Levendusky et al. | 219/10.55 E |
| 4,703,148 | 10/1987 | Mikulski et al. | 219/10.55 E |
| 4,775,771 | 10/1988 | Pawlowski et al. | 219/10.55 E |
| 4,777,053 | 10/1988 | Tobelmann et al. | 219/10.55 E |
| 4,785,160 | 11/1988 | Hart | 219/10.55 E |
| 4,835,352 | 5/1989 | Sasaki et al. | 219/10.55 E |

*Primary Examiner*—Philip H. Leung

*Attorney, Agent, or Firm*—Sixbey, Friedman, Leedom & Ferguson

[57] ABSTRACT

A disposable microwave browning and crisping package comprising a flexible or semirigid substrate and a microwave interactive layer affixed over one surface of said substrate, said microwave interactive layer, when subjected to microwave energy, operating as a means for converting microwave energy to heat in an amount sufficient to brown or crisp food in heat transfer relationship therewith. The package has non-dispersed, localized microwave permeable means which allows a percentage of the available microwave energy to traverse said package so as to produce dielectric heating within the center of the food product contained herein.

12 Claims, 1 Drawing Sheet

APERTURED MICROWAVE REACTIVE PACKAGE

This application is a continuation of application Ser. No. 186,334, filed Apr. 26, 1988, now abandoned.

BACKGROUND OF THE INVENTION

1. Field of the Invention

The present invention relates to a disposable microwave reactive cooking, crisping, and browning package for foods which produces a thermal heating effect when exposed to microwave energy and which contains aperture means to allow microwave energy to dielectrically heat the center of food products contained therein.

2. Background Art

The heating and cooking of food products with microwave energy has now become extremely popular. As manufacturers of microwaveable foods attempt to meet the public's demand for additional varieties of foods which can be prepared in a microwave oven, they have experienced problems associated with enabling the product to be cooked in a microwave oven without resulting in areas which are either overcooked or undercooked. It is also desired that the cooked product possess a degree of browning or crispness which such foods normally have when cooked in a conventional oven.

Various forms of specialized packages have been developed which are designed to achieve microwave browning of foods cooked therein. These packages contain a reactive film or element which converts microwave energy into thermal energy and produces browning and crisping of an item of food situated adjacent said heating element. In some cases the food is disposed within an outer package body that is used for shipping and storage as well as for heating of the food product. In other cases, the food is disposed on a tray-like member that is situated within an outer package body for shipping and storage, but is removed or rearranged relative to the outer package body when the food item is to be heated.

One type of disposable package that is used for both shipping and storage as well as heating of items of food is represented by Brastad U.S. Pat. No. 4,267,420 and Bradtad et al., U.S. Pat. No. 4,230,924. In these patents, flexible and semi-rigid sheets of microwave interactive materials are wrapped closely about individual items of food so that when the package is exposed to microwave energy, at least a portion of the microwave energy impinging the package will be converted into heat for browning the surface of the food. However, such packages have been found to pose problems with various types of food which give off heat, grease, or vapor. Furthermore, some irregularly shaped foods may be difficult to wrap and contain without unacceptable bunching of the sheet material. Uneven heating, browning, and cooking of the food has also been experienced.

U.S. patent application No. 79,420, filed July 30, 1987, discloses a microwave browning and crisping package and method of microwave heating of food wherein a paperboard container has a microwave interactive layer affixed over one surface of the container, the inner peripheral surface defining a space for receiving a food product with top, bottom and side surfaces of the food product being in heat transfer relationship with respect to the microwave interactive layer. In use, a food item and sleeve are removed form the package body, the sleeve erected and the food item inserted therein, after which the food in the sleeve is placed in a microwave oven and heated.

These packages produced excellent cooking, crisping and browning results with low density foods. With frozen high density foods, however, the outer surface of the food browned and crisped while the center of the product remained uncooked. Products such as chimichungas and burritos could not be evenly cooked and browned in these packages. At the end of the cook cycle, a uniform temperature range of 160°–180° F. throughout the entire food product is the desired result.

SUMMARY OF THE INVENTION

The subject invention is a disposable microwaveable package which allows food contained therein to be cooked in an enhanced and refined manner.

A predetermined amount of an oven's microwave energy is absorbed by an interactive film (also referred to hereinafter as an interactive heater) and converted into thermal energy. The food surfaces which are adjacent the reactive heater absorb the thermal energy. Cooking, crisping, and browning proceeds as if the food product were in contact with a conventional heated surface such as a grill on frying pan.

A second predetermined amount of the oven's microwave energy is used to dielectrically heat the food product contained in the package. As mentioned in the previous paragraph, microwaves striking the reactive heater are absorbed and converted into heat. Microwaves which strike the package at locations which have no interactive film penetrate the container and enter the food product contained therein. These microwaves which reach the food product penetrate the product and produce dielectric heating therein.

As will be seen from the detailed description of the invention, various parameters of the package may be changed so as to optimize the ratio of thermal heating to dielectric heating and thereby customize the package design to suit the needs of all types and configurations of food products.

One object of the present invention is to provide an improved microwaveable disposable package, which allows the internal temperature of the food product contained therein to rise sufficiently fast so as to fully cook the inside of the product during the normal cook cycle.

A further object of the present invention is to provide an improved microwave browning and crisping package which will decrease the cooking time required for the contained food product while still providing good crisping and browning.

A further object of the present invention is to provide internal heating to the food product in a manner which allows the center of the food product to cook as fast as its ends, thereby keeping the ends from getting too dark and tough.

A further object of the present invention is to provide an improved microwave browning and crisping package, for the cooking of food products such as chimichungas, burritos, and sandwiches.

DETAILED DESCRIPTION OF THE INVENTION

Figure 1:
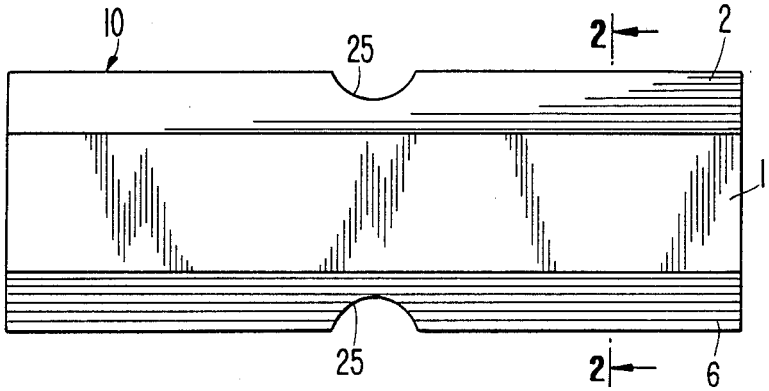
FIG. 1 is a top view of the crisping package illustrating the features of the invention.
Figure 2:
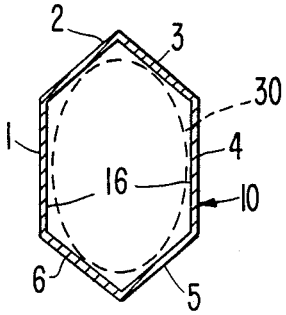
FIG. 2 is a cross sectional view of the crisping package taken in the direction of line 2—2 of FIG. 1
Figure 3:
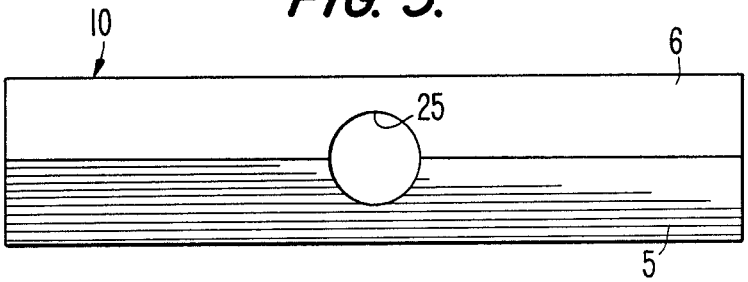
FIG. 3 is a side view of the crisping package illustrated in FIG. 1

A microwave browning and crisping package (FIG. 1) is designated by the reference numeral 10 and is in the nature of a paperboard container, such as a sleeve, that has been subdivided by fold lines into a plurality of panels 1–6. The inner peripheral surface of the sleeve 10 is provided with a layer of a microwave interactive material 16 which, when subjected to microwave energy, will operate to convert the microwave energy to heat in an amount sufficient to brown or crisp food surfaces that are in contact with or in close proximity to the microwave interactive layer. A suitable laminate which may be used for such a disposable paperboard container is disclosed, for example, in U.S. Pat. No. 4,641,005.

As will be explained more fully hereinafter, microwave permeable apertures 25 of a predetermined size may be formed in the sleeve to effect a desired ratio of microwave absorption by the food to microwave absorption by the interactive layer when using a package such as sleeve 10 illustrated in FIG. 1 without the microwave permeable apertures, microwave energy produced by the magnetron in a microwave oven strikes the entire package and converts microwave energy into thermal energy by means of the interactive layer 16. As the temperature of the interactive layer 16 increases, thermal energy is transferred from the interactive layer to the food product 30 contained in the package. The thermal energy initially strikes the surface of the food product 30 and slowly penetrates. For certain types of low density unfrozen foods, the unapertured sleeve 10 provides good results, that is, at the end of the usual cook cycle, the food product has been evenly heated and cooked throughout and the outer surface is crisp and brown. When cooking certain types of foods such as frozen chimichungas and burritos, however, the outer surface becomes brown and crisp while the center of the food product remains uncooked. Extending the length of the cook cycle does eventually heat the interior of the food product, but at that point the outside is overcooked and burned.

Inserting microwave permeable apertures 25 in the package alleviates the aforementioned problems. During the initial phase of the cook cycle, microwave energy strikes the package 10 and apertures 25. The microwaves striking the interactive layer 16 of the sleeve are converted into thermal energy for heating and browning of the outer surface of the food product. The microwaves which strike the aperture 25 are allowed to enter the container and penetrate the food product. Heating of the center of the food product is accomplished by the usual dielectric heating which results when food is placed in a conventional microwave oven. By controlling the ratio of the amount of microwave energy reached the food product through apertures 25 and the amount striking the interactive material or layer 16 of the package, the even and uniform cooking and browning of the food product is accomplished.

The reactive heater 16 consists of a very thin lossy layer of aluminum having a surface resistance between 1 and 8 ohms per square inch. As noted in the prior art, the thickness of the aluminum layer is not directly mechanically measurable, but calculations indicate that a film of aluminum used as the metal forming interactive layer 16 would have a thickness of between 200 and 300 angstroms if its resistance were 1.5 ohms per square inch.

The metal layer 16 must be sufficiently thin so as to be readily and rapidly heated upon expose to microwave radiation. Such heating of the layer must be rapid and must reach a sufficient temperature so as to brown and crisp the exterior of the food during the normal cooking cycle.

It has been found that interactive layer 16 having a surface resistance of approximately 2 ohms per square inch is capable of achieving a temperature in excess of 200° F. within 30 seconds in a conventional 600 watt microwave oven. Likewise, interactive layer 16 having a surface resistance of approximately 4 ohms per square inch will achieve a temperature exceeding 200° F. between 20 and 30 seconds of cooking time.

It has been found that as the surface resistance of the interactive layer 16 increases, the faster the layer heats up when exposed to microwave radiation.

The normal cook cycle for commercially produced chimichungas and burritos is between 5–6 minutes in a conventional 600 watt microwave oven. Accordingly, the interactive layer 16 has to reach a temperature in excess of 200° F. and must provide sufficient browning and crisping of the food product within the 5–6 minute normal cook cycle.

Although a lossy layer of aluminum was used as a microwave energy absorbing interactive heater in the preceding example, a very thin layer of lossy material made from other metal and metal compounds could be used. Ferrites and carbon particles could also be used. The lossy layer of material may be applied to a substrate plastic film, such as polyester, by vacuum vapor deposition and bonded to paperboard as suggested in U.S. Pat. No. 4,641,005 or by a relatively thin paint type layer as suggested in U.S. Pat. No. 4,190,757.

EXAMPLE 1

A non-apertured interactive sleeve 8" in length, 3½" wide and 1½" high, containing 244 grams of frozen beef burrito was subject to heating in a 600 watt conventional microwave oven for 6 minutes. The center temperature of the food product reached a maximum of 58° F.

EXAMPLE 2

An interactive apertured sleeve 8" in length, 3½" wide and 1½" high, having a ½" diameter aperture on each of two sides and centered, and containing the same food product as stated in the preceding Example, was subject to heating in a 600 watt conventional microwave oven for 6 minutes. Good crisping was obtained. The center temperature of the product reached 146° F.

EXAMPLE 3

An interactive apertured sleeve 8" in length, 3½" wide and 1½" high, having two (2) ½" diameter apertures on each of two sides and containing the same food product as stated in the preceding Example, was subjected to heating in a 600 watt conventional microwave oven for 6 minutes. Good crisping was obtained. The center temperature of the product reached 164° F.

EXAMPLE 4

An interactive sleeve 8" in length, 3½" wide and 1½" high, having three (3) ½" diameter apertures on each of two sides, and containing the same food product as stated in the preceding Example, was subjected to heating in a 600 watt conventional microwave oven for 6 minutes. Good crisping was obtained. The center temperature of the product reached 175° F.

EXAMPLE 5

An interactive apertured sleeve 8" in length, 3½" wide and 1½" high, having a 1½" diameter aperture on each of two sides and centered, and containing the same food product as stated in the preceding Example, was subjected to heating in a 600 watt conventional microwave oven for 6 minutes. Good crisping was obtained. The center temperature of the product reached 166° F.

EXAMPLE 6

An interactive apertured sleeve 8" in length, 3½" wide and 1½" high, having a ½×1" rectangle aperture on each of two sides and centered, and containing the same food product as stated in the preceding Example, was subjected to heating in a 600 watt conventional microwave for 6 minutes. Good crisping was obtained. The center temperature of the product reached 164° F.

EXAMPLE 7

A non-apertured flexible sleeve 8" in length, 3½" wide and 1½" high, containing 244 grams of beef burritos was subjected to heating in a 600 watt conventional microwave oven for 6 minutes. The center temperature of the food product was as low at 88° F.

EXAMPLE 8

An interactive apertured flexible sleeve 8" in length, 3½" wide and 1½" high, having a ½" diameter aperture on each of two sides and centered, and containing the same food product as stated in the preceding Example, was subjected to heating in a 600 watt conventional microwave oven for 6 minutes. Good crisping was obtained. The center temperature of the product averaged 147° F.

EXAMPLE 9

A non-apertured interactive sleeve 7" in length, 3½" wide and 1¼" high, containing 254 grams of frozen chicken chimichunga was subjected to heating in a 700 watt conventional microwave oven for 6 minutes. The center temperature of the food product reached 107° F.

EXAMPLE 10

An interactive apertured sleeve 7" in length, 3½" wide and 1¼" high, having a ½" diameter aperture on each of two sides and centered, and containing the same food product as stated in the preceding Example, was subjected to heating in a 700 watt conventional microwave oven for 6 minutes. Good crisping was obtained. The center temperature of the product reached 176° F.

The above examples demonstrate that when an interactive sleeve, formed in accordance with the subject invention, and provided with from one to six apertures of ½" to 1½" diameter, is used to heat a food item, such as a 244 gram, frozen beef burrito, the internal temperature of the food item can reach 146°–176° F. and also can show good surface crisping. See Examples 2–6, 8 and 10. On the other hand, similar sleeves without apertures formed in accordance with the subject invention used to cook food items under similar conditions may produce an internal temperature of only 58° F. to 107° F. See Examples 1, 7 and 9. Clearly, the disclosed invention is highly advantageous in producing the desired result of adequate internal heating without sacrificing good surface crisping. Each aperture described in the examples above inherently form a localized, non-interactive, microwave permeable area in the continuous interactive layer 16 through which microwave energy may pass. The aperture in each sleeve forms a microwave apportioning means for creating a desired division between the microwave absorptivity of interactive layer 16 and the microwave absorptivity of the food item within the sleeve. Each aperture is inherently surrounded by an uninterrupted edge of the interactive layer with all diametrically opposed sections of each edge being sufficiently separated to preclude microwave interactivity therebetween of the type disclosed in U.S. Pat. No. 4,230,924, which describes a discontinuous layer of microwave interactive metal islands separated by gaps varying from 0.0001 to 0.0025 inches in width to cause current flow from one island to the next when subjected to microwave energy.

It should be recognized that while various embodiments in accordance with the present invention have been described, the present invention will be susceptible to numerous other changes and modifications which will become apparent to those skilled in the art from the foregoing disclosure. Therefore, the present invention should not be considered to be limited to the details shown and described herein, but encompasses all such changes and modifications as are within the scope of the appended claims.

What I claim is:

1. A microwave food package assembly for achieving a desired balance of external surface and internal heating of food in a microwave oven, comprising (a) a food item having a density and external dimensions which would normally result in the surface of said food item becoming excessively heated before the interior of said food item is adequately and uniformly heated when subjected to unshielded microwave energy;

(b) a sleeve having bottom, top, and opposed side walls and open ends, said sleeve being shaped to be placed in surrounding heat conducting relationship with respect to the top, bottom and sides of said food item such that the ends of said food items are exposed to direct impingement by microwave energy when said food item is heated in a microwave oven, said sleeve being formed of microwave transparent material;

(c) a microwave interactive means for absorbing a portion of the microwave energy within the oven and converting the absorbed microwave energy into heat to raise the temperature of said microwave interactive means, said interactive means including a continuous layer of microwave interactive material which permits a limited portion of the microwave energy to be transmitted from outside the package assembly through said microwave interactive means into said food item, said microwave interactive material being coextensive with the entire inner surface of said sleeve and being positioned, because of the shape of said sleeve, adjacent the top, bottom and sides of said food item to cause the top, bottom and sides of said food item to be heated by said microwave interactive material, the degree of interactivity of said microwave interactive material being sufficiently great that the sum of the microwave energy reaching said food item by being transmitted through said microwave interactive material and through the open ends of said sleeve is inadequate to cause the interior of said food item to be adequately heated when the surface of said food item reaches the maximum level of desired surface heating; and (d) microwave apportioning means for creating a desired division between the microwave absorptivity of said microwave interactive material and the microwave absorptivity of said food item, said microwave apportioning means including a portion of said microwave interactive layer surrounding at least a pair of localized non-interactive microwave permeable areas through which microwave energy may pass into the interior of said food item, said areas being surrounded by uninterrupted edges of said continuous microwave interactive material with all diametrically opposed sections of said edge being sufficiently separated to preclude microwave interactivity between said diametrically opposed sections, said microwave apportioning means including at least a pair of apertures formed in the portions of said microwave interactive material which are co-extensive with said opposed side walls.

2. A microwave packaging component as defined in claim 1, wherein said apertures extend through said microwave transparent material.

3. A microwave packaging assembly as defined in claim 1, wherein said microwave interactive layer is a thin layer of metal and said microwave transparent material is formed of paperboard.

4. A microwave packaging assembly as defined in claim 1, wherein said microwave permeable areas are formed by apertures extending through said microwave interactive layer and said microwave transparent material.

5. A microwave packaging assembly defined in claim 4, wherein said sleeve is approximately eight inches in length, 3½ inches wide and 1½ inches high and said apertures are circular and each has a diameter of approximately ½ inch.

6. A microwave packaging assembly as defined in claim 5, wherein said food item includes a frozen meat product having a mass of approximately 250 grams.

7. A microwave packaging assembly as defined in claim 4, wherein said apertures are rectangular in shape.

8. A microwave packaging assembly as defined in claim 7 wherein said rectangular apertures are approximately ½ inch by 1 inch.

9. A microwave packaging assembly as defined in claim 1, wherein said aperture is generally circular and has a diameter of approximately ½ inch.

10. A microwave package assembly as defined in claim 1 wherein said microwave apportioning means includes a plurality of additional apertures identical in size and shape to said pair of apertures formed in said sleeve.

11. A microwave packaging assembly as defined in claim 1 wherein said food item includes a frozen meat product.

12. A microwave packaging assembly as defined in claim 11, wherein said frozen meat product has a mass of approximately 250 grams.

* * * * *